US006811031B1

(12) United States Patent
Adams et al.

(10) Patent No.: US 6,811,031 B1
(45) Date of Patent: Nov. 2, 2004

(54) METHOD AND DEVICE FOR SEPARATING ORE

(76) Inventors: E. Verl Adams, 215 E. 100 North #20, Spanish Fork, UT (US) 84660; Joyce B. Adams, 215 E. 100 North #20, Spanish Fork, UT (US) 84660

( * ) Notice: Subject to any disclaimer, the term of this patent is extended or adjusted under 35 U.S.C. 154(b) by 224 days.

(21) Appl. No.: 10/137,256

(22) Filed: May 2, 2002

(51) Int. Cl.[7] ..... B03B 1/02
(52) U.S. Cl. ..... 209/3; 209/12.1
(58) Field of Search ..... 209/3, 12.1, 18, 209/629, 132, 155, 156, 159, 172.5, 725, 369, 370, 372, 373, 505; 208/39, 41, 407, 424

(56) References Cited

U.S. PATENT DOCUMENTS 4,003,559 A * 1/1977 Kuwano et al. ..... 266/204
4,033,863 A * 7/1977 Stone ..... 209/159
4,110,194 A * 8/1978 Peterson et al. ..... 208/390
4,222,860 A * 9/1980 Park ..... 209/159
4,737,267 A * 4/1988 Pao et al. ..... 208/432
5,124,008 A * 6/1992 Rendall et al. ..... 205/560
5,249,688 A * 10/1993 Hwang ..... 209/170
5,894,935 A * 4/1999 Stein ..... 209/210
6,079,567 A * 6/2000 Gray ..... 209/44

FOREIGN PATENT DOCUMENTS

FR 2.594.713 A1 * 8/1987 ..... B03D/1/00
JP 59-215332 A * 12/1984 ..... C08J/11/04

* cited by examiner

*Primary Examiner*—Donald P. Walsh
*Assistant Examiner*—Mark Beauchaine

(57) ABSTRACT

Methods and devices for separating ore extract valuable minerals. Valuable minerals are typically found encased in rock in modest concentrations. For the minerals to be useful, they must be separated from the rock and purified. Methods and devices for separating ore provide the process and equipment needed to separate the various components of ore so that those having value can be recovered.

18 Claims, 3 Drawing Sheets

METHOD AND DEVICE FOR SEPARATING ORE

BACKGROUND OF THE INVENTION

1. Field of the Invention

The present invention relates to a method and device for separating ore for use in connection with ore processing. The method and device for separating ore has particular utility in connection with extracting valuable minerals.

2. Description of the Prior Art

Methods and devices for separating ore are desirable for extracting valuable minerals. Valuable minerals are typically found encased in rock in modest concentrations. For the minerals to be useful, they must be separated from the rock and purified. Methods and devices for separating ore provide the process and equipment needed to separate the various components of ore so that those having value can be recovered.

The use of dynamic mining systems comprising hydrated multiple recovery sites and related methods is known in the prior art. For example, U.S. Pat. No. 5,868,995 to Tanner discloses a dynamic mining system comprising hydrated multiple recovery sites and related methods that recovers gold and/or other heavy metals along a continuously hydrated ore processing route. However, the Tanner '995 patent does not function without the use of multiple pumps, conveyors, and boil boxes, and has further drawbacks of requiring massive amounts of carrier and secondary water.

U.S. Pat. No. 5,124,008 to Rendall et al. discloses a method of extraction of valuable minerals and precious metals from oil sands ore bodies and other related ore bodies. However, the Rendall et al. '008 patent does not work without the use of sodium cyanide, and additionally does not have a motordriven paddle.

Similarly, U.S. Pat. No. 4,071,143 to Richan discloses an ore separating method and apparatus. However, the Richan '143 patent does not have a motor-driven paddle, and does not have a vessel with a conical-shaped bottom.

In addition, U.S. Pat. No. 4,647,307 to Raudsepp et al. discloses a process for recovering gold and silver from refractory ores. However, the Raudsepp et al. '307 patent does not function without the use of an oxidized nitrogen species, and does not have a motordriven paddle.

Furthermore, U.S. Pat. No. 4,715,949 to Watts discloses a heavy metal separator that removes heavy metal particles and flakes from ore. However, the Watts '949 patent does not have a motor-driven paddle, and cannot be used without a continuous stream of water.

Lastly, U.S. Pat. No. Des. 335,294 to Vallien discloses a centrifugal separator. However, the Vallien '294 patent does not have a motor-driven paddle, and has the additional deficiency of lacking a vessel with a conical-shaped bottom.

While the above-described devices fulfill their respective, particular objectives and requirements, the aforementioned patents do not describe a method and device for separating ore that allows extracting valuable minerals. The Rendall et al. '008 patent, the Richan '143 patent, the Raudsepp et al. '307 patent, the Watts '949 patent, and the Vallien '294 patent make no provision for a motor driven paddle. The Tanner '995 patent requires massive amounts of carrier and secondary water. The Watts '949 patent requires a continuous stream of water.

Therefore, a need exists for a new and improved method and device for separating ore that can be used for extracting valuable minerals. In this regard, the present invention substantially fulfills this need. In this respect, the method and device for separating ore according to the present invention substantially departs from the conventional concepts and designs of the prior art, and in doing so provides an apparatus primarily developed for the purpose of extracting valuable minerals.

SUMMARY OF THE INVENTION

In view of the foregoing disadvantages inherent in the known types of dynamic mining systems comprising hydrated multiple recovery sites and related methods now present in the prior art, the present invention provides an improved method and device for separating ore, and overcomes the above-mentioned disadvantages and drawbacks of the prior art. As such, the general purpose of the present invention, which will be described subsequently in greater detail, is to provide a new and improved method and device for separating ore to extract valuable minerals which has all the advantages of the prior art mentioned heretofore and many novel features that result in a method and device for separating ore which is not anticipated, rendered obvious, suggested, or even implied by the prior art, either alone or in any combination thereof To attain this, the present invention essentially comprises a vessel having a removable lid on top and an outlet valve attached to its bottom. Within the vessel is an agitator. The present invention also comprises a method for separating ore, which comprises the steps of: crush ore until concentrate is freed from the rock, wet screen crushed ore to separate the concentrate from the rock, boil the concentrate in water in a vessel, capture resultant released gases if valuable, allow water to cool until the concentrate accumulates as sediment in the bottom of the vessel, remove water, leaving the concentrate in the vessel, introduce super heated water to the vessel to separate the tars and oils, transfer the concentrate/water solution to a cylindrical vessel having a conical bottom with a valve, a side valve, and a motor-driven paddle, rotate the paddle rapidly once the vessel is full of solution until all of the concentrate is suspended, slow the paddle gradually until it comes to a stop, and utilize the valves to remove the separated minerals once all materials have settled out.

There has thus been outlined, rather broadly, the more important features of the invention in order that the detailed description thereof that follows may be better understood and in order that the present contribution to the art may be better appreciated.

The invention may also include the vessel having a conical-shaped bottom. A skim valve may be attached to the side of the vessel. Legs with leg supports may be attached to the side and bottom of the vessel. The agitator may take the form of a motor, motor retainer, screws, and reduction gearbox attached to the top of the lid, along with a drive shaft, paddle support, square drive, bushing, paddle holder, rivets, and paddle contained within the vessel. There may also be an inlet pipe attached to the top of the lid. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved method and device for separating ore that has all of the advantages of the prior art dynamic mining systems comprising hydrated multiple recovery sites and related methods and none of the disadvantages.

It is another object of the present invention to provide a new and improved method and device for separating ore that may be easily and efficiently manufactured and marketed.

An even further object of the present invention is to provide a new and improved method and device for separating ore that has a low cost of manufacture with regard to both materials and labor, and which accordingly is then susceptible of low prices of sale to the consuming public, thereby making such method and device for separating ore economically available to the buying public.

Still another object of the present invention is to provide a new method and device for separating ore that provides in the apparatuses and methods of the prior art some of the advantages thereof, while simultaneously overcoming some of the disadvantages normally associated therewith.

Even still another object of the present invention is to provide a method and device for separating ore for extracting valuable minerals. This allows the separation of valuable minerals from low value materials.

Still yet another object of the present invention is to provide a method and device for separating ore for extracting valuable minerals. This makes it possible to separate valuable minerals without requiring a continuous flow of water.

An additional object of the present invention is to provide a method and device for separating ore for extracting valuable minerals. This enables the separation of valuable minerals without the use of sodium cyanide.

Lastly, it is an object of the present invention to provide a new and improved method and device for separating ore for extracting valuable minerals.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
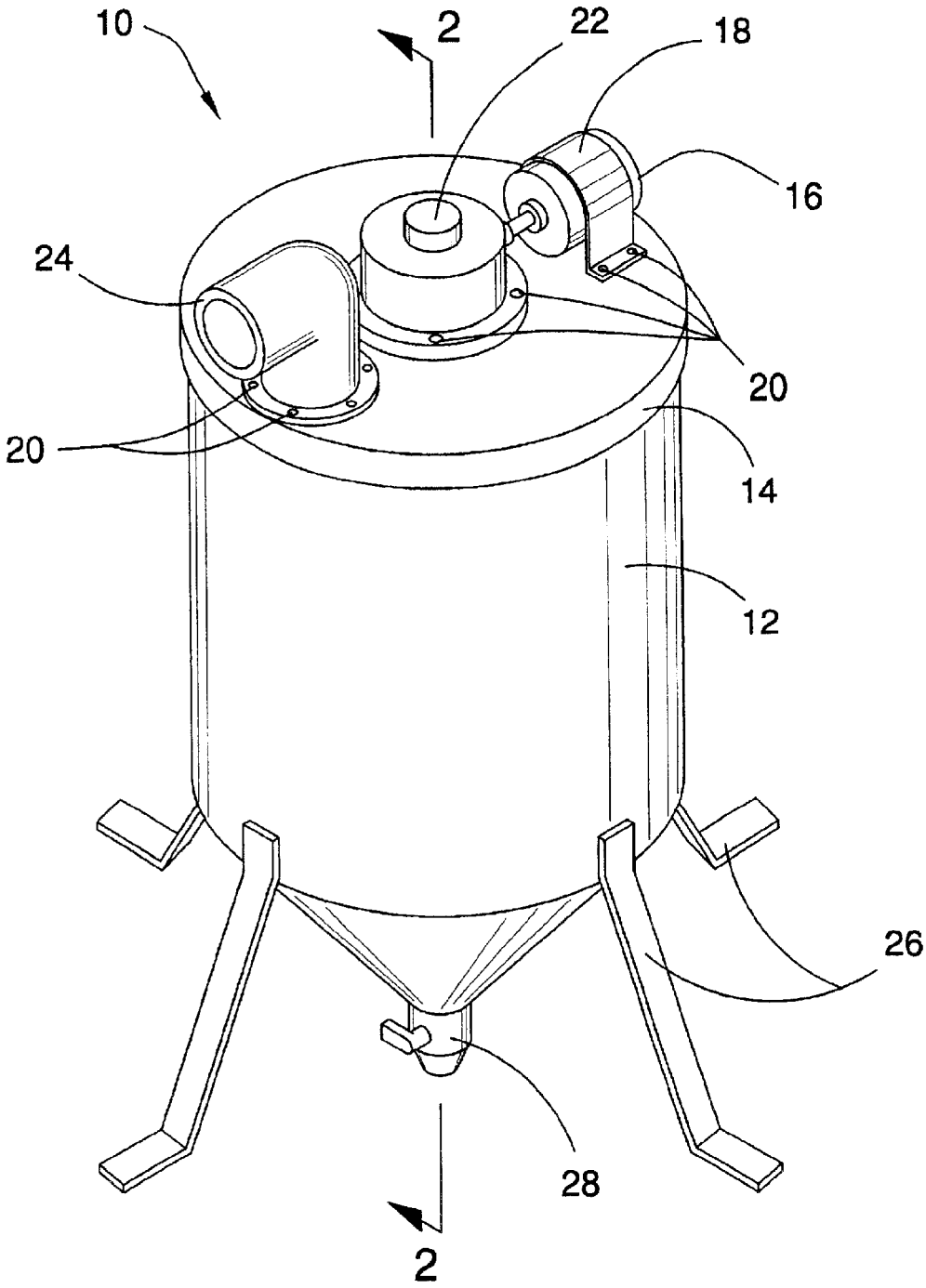
FIG. 1 is a top perspective view of the current embodiment of the device for separating ore constructed in accordance with the principles of the present invention.
Figure 2:
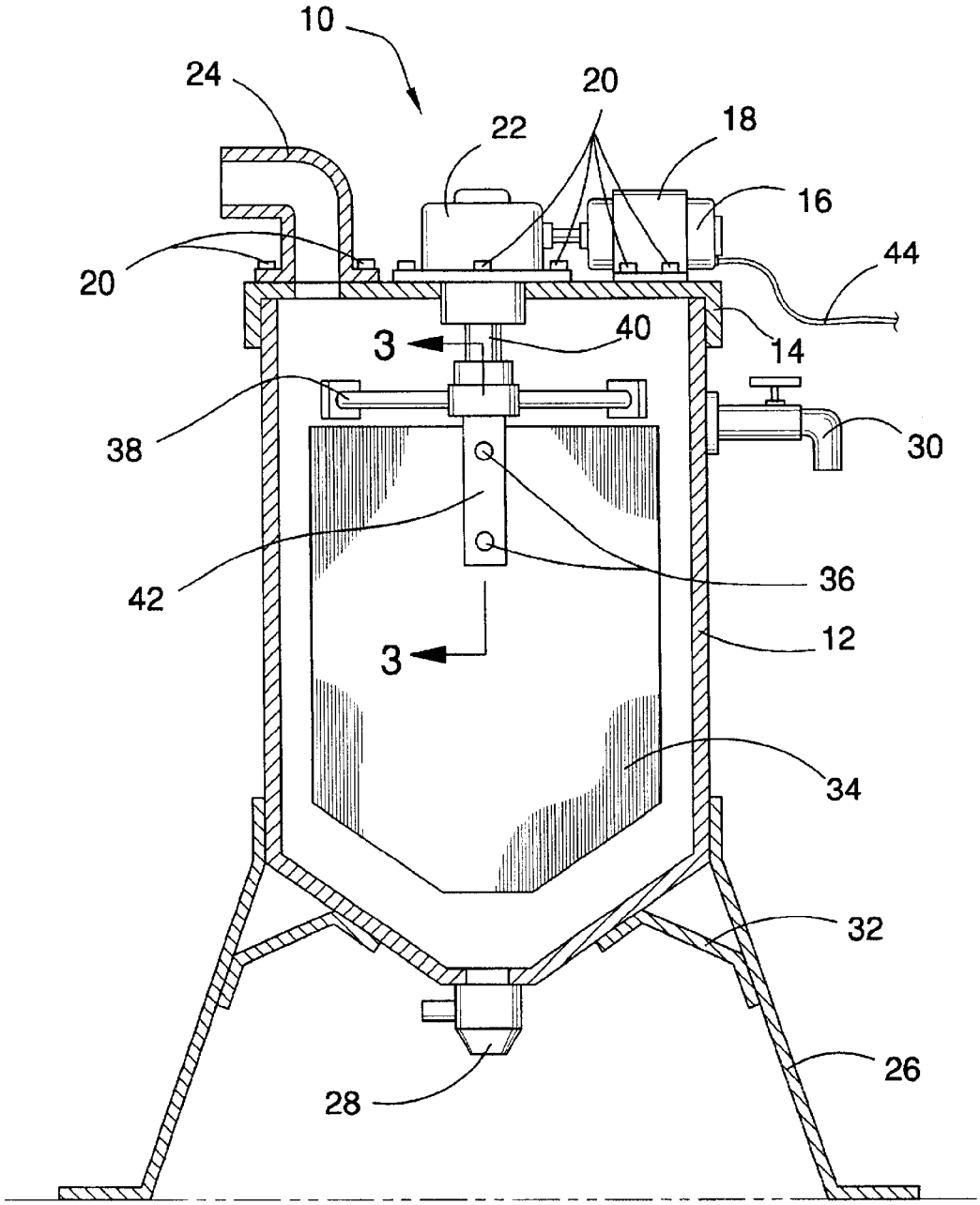
FIG. 2 is a side sectional view of the device for separating ore of the present invention.
Figure 3:
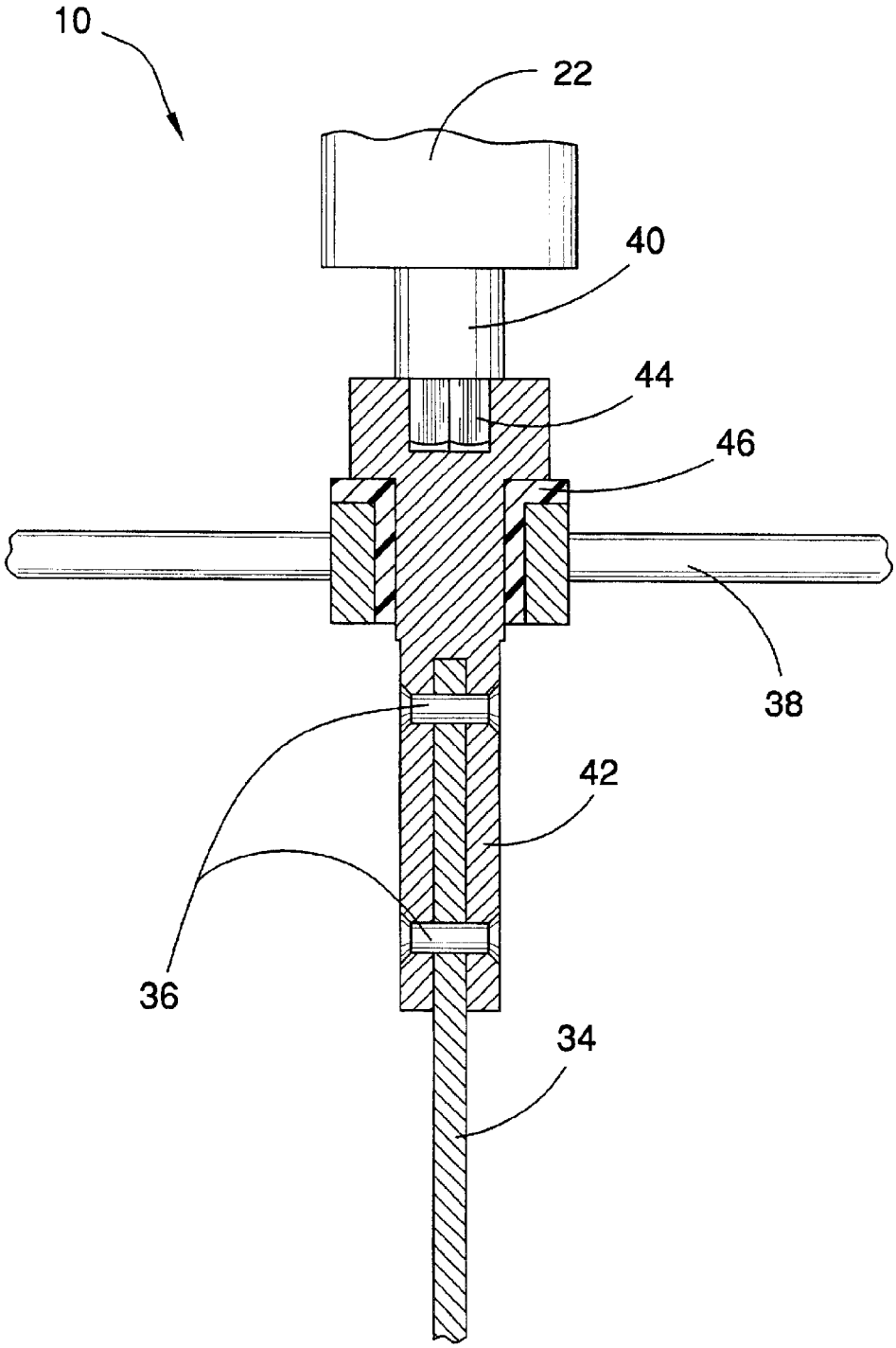
FIG. 3 is a side sectional view of the device for separating ore of the present invention.

Referring now to the drawings, and particularly to FIGS. 1–3, a current embodiment of the device for separating ore of the present invention is shown and generally designated by the reference numeral 10.

In FIG. 1, a new and improved device for separating ore 10 of the present invention for extracting valuable minerals is illustrated and will be described. More particularly, the device for separating ore 10 has a cylindrical vessel 12 made of steel with a conical-shaped bottom. Attached to the bottom of vessel 12 is outlet valve 28. Attached to the side wall of vessel 12 are legs 26 made of steel. Removably attached to vessel 12 is lid 14 made of steel. Threadedly attached to lid 14 by screws 20 are inlet pipe 24, made of steel, reduction gearbox 22, and motor retainer 18. Attached to motor retainer 18 is motor 16. Motor 16 is connected to reduction gearbox 22.

Moving on to FIG. 2, a new and improved device for separating ore 10 of the present invention for extracting valuable minerals is illustrated and will be described. More particularly, the device for separating ore 10 has a vessel 12 with lid 14. Leg supports 32 are shown reinforcing legs 26. Outlet valve 28 is visible at the bottom of vessel 12. Motor 16, motor retainer 18, reduction gearbox 22, and inlet pipe 24 are shown threadedly attached to lid 14 by screws 20. Power cord 44 is shown connected to motor 16. Connected to reduction gearbox 22, and contained within vessel 12, are driveshaft 40, paddle support 38, paddle holder 42, rivets 36, and paddle 34. Paddle 34 is attached to paddle holder 42 by rivets 36. Paddle support 38 supports paddle holder 42 and driveshaft 40. Skim valve 30 is shown attached to the side wall of vessel 12.

Lastly, in FIG. 3, a new and improved device for separating ore 10 of the present invention for extracting valuable minerals is illustrated and will be described. More particularly, the device for separating ore 10 has a reduction gearbox 22. Connected to reduction gearbox 22 is driveshaft 40. Driveshaft 40 connects to paddle holder 42 by a square drive 44. Paddle holder 42 is rotatably mounted in paddle support 38 by bushing 46. Rivets 36 hold paddle 34 in paddle holder 42.

In use, it can now be understood that a concentrate/water solution prepared in accordance with the method for separating ore is introduced into the vessel 12 via inlet pipe 24. Following the method for separating ore, the motor is energized to rapidly rotate paddle 34 via the reduction gearbox 22 and related drive components. Once all of the concentrate is suspended in the water, the motor 16 is gradually slowed to a stop, simultaneously slowing the paddle 34 to a stop. Once all of the material suspended in the water have settled out, the outlet valve 28 and the skim valve 30 can be used to remove the separated materials and the water. The lid 14 can be removed from time to time for cleaning and maintenance of the interior of vessel 12 and the drive components contained within vessel 12.

While a current embodiment of the device for separating ore has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as stainless steel, titanium, or aluminum may be used instead of the steel vessel, inlet pipe, and legs described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for separating ore, which comprises the steps of:

a. crush ore until concentrate is freed from the rock;

b. wet screen crushed ore to separate the concentrate from the rock;

c. boil the concentrate in water in a vessel;

d. capture resultant released gases if valuable;

e. allow water to cool until the concentrate accumulates as sediment in the bottom of the vessel;

f. remove water, leaving the concentrate in the vessel;

g. introduce super heated water to the vessel to separate any tars and oils;

h. transfer the concentrate/water solution to a cylindrical vessel having a conical bottom with a valve, a side valve, and a motor-driven paddle;

i. rotate the paddle rapidly once the vessel is fill of solution until all of the concentrate is suspended;

j. slow the paddle gradually until it comes to a stop;

k. utilize the valves to remove the separated minerals once all materials have settled out.

2. A device for separating ore comprising:

a vessel having a top, a bottom, and a sidewall;

a lid having a top removably attached to said top of said vessel;

a drive mechanism contained within said vessel, a paddle rotatably mounted on said drive mechanism, wherein said paddle is rotated rapidly once said vessel is full of a concentrate solution until all of said concentrate is suspended and then said paddle is gradually slowed to a stop to initiate separation of said concentrate, and an outlet valve attached to said bottom of said vessel.

3. The device for separating ore as defined in claim 2, further comprising legs having a rear surface attached to said sidewall of said vessel.

4. The legs as defined in claim 3, further comprising leg supports having opposing ends with one end attached to said bottom of said vessel and said opposite end attached to said rear surface of said legs.

5. The legs as defined in claim 3, further comprising leg supports having opposing ends with one end attached to said bottom of said vessel and said opposite end attached to said rear surface of said legs.

6. The device for separating ore as defined in claim 2, further comprising an inlet pipe attached to said top of said lid.

7. The device for separating ore as defined in claim 2, further comprising a skim valve attached to said sidewall of said vessel.

8. The drive mechanism as defused in claim 2, wherein said drive mechanism comprises:

a motor, a reduction gear box connected to said motor;

a drive shaft connected to said reduction gear box;

a square drive attached to said drive shaft;

a paddle holder attached to said square drive;

a bushing enclosing said paddle holder;

a paddle support enclosing said bushing; and rivets inserted through said paddle holder.

9. The vessel as defined in claim 2, wherein said sidewall of said vessel is cylindrical in shape.

10. The vessel as defined in claim 2, wherein said bottom of said vessel is conical in shape.

11. The vessel as defined in claim 2, wherein said vessel is selected from the group consisting of steel, stainless steel, titanium, and aluminum.

12. The vessel as defined in claim 2, wherein said vessel is selected from the group consisting of steel, stainless steel, titanium, and aluminum.

13. A device for separating ore comprising:

a vessel having a top, a bottom, and a sidewall;

a lid having a top removably attached to said top of said vessel;

a drive mechanism contained within said vessel;

a paddle rotatable mounted on said drive mechanism, wherein said paddle is rotated rapidly once said vessel is full of a concentrate solution until all of said concentrate is suspended and then said paddle is gradually slowed to a stop to initiate separation of said concentrate agitator, an outlet valve attached to said bottom of said vessel;

an inlet pipe attached to said top of said lid;

screws threadedly attaching said inlet pipe to said top of said lid; and a skim valve attached to said sidewall of said vessel.

14. The device for separating ore as defined in claim 13, further comprising legs having a rear surface attached to said sidewall of said vessel.

15. The drive mechanism as defined in claim 13, wherein said drive mechanism comprises:

a motor, a motor retainer attached to said motor;

screws threadedly attaching said motor retainer lo said top of said lid;

a reduction gear box connected to said motor;

screws threadedly attaching said reduction gear box to said top of said lid;

a drive shaft connected to said reduction gear box;

a square drive attached to said drive shaft;

a paddle holder attached to said square drive;

a bushing enclosing said paddle holder;

a paddle support enclosing said bushing; and rivets inserted through said paddle holder.

16. The paddle as defined in claim 15, wherein said paddle is selected from the group consisting of steel, stainless steel, titanium, and aluminum.

17. The vessel as defined in claim 13, wherein said sidewall of said vessel is cylindrical in shape.

18. The vessel as defined in claim 13, wherein said bottom of said vessel is conical in shape.

* * * * *